US007131437B2

(12) United States Patent
Ando et al.

(10) Patent No.: US 7,131,437 B2
(45) Date of Patent: Nov. 7, 2006

(54) IGNITION DEVICE FOR INTERNAL COMBUSTION ENGINE

(75) Inventors: Koji Ando, Kariya (JP); Haruo Kawakita, Okazaki (JP)

(73) Assignee: DENSO Corporation, Kariya (JP)

( * ) Notice: Subject to any disclaimer, the term of this patent is extended or adjusted under 35 U.S.C. 154(b) by 0 days.

(21) Appl. No.: 11/118,327

(22) Filed: May 2, 2005

(65) Prior Publication Data

US 2005/0252496 A1 Nov. 17, 2005

(30) Foreign Application Priority Data

May 11, 2004 (JP) ..... 2004-141211
Jan. 7, 2005 (JP) ..... 2005-002819

(51) Int. Cl.
*F02P 3/05* (2006.01)
*F02P 3/055* (2006.01)

(52) U.S. Cl. ..... 123/644; 123/630

(58) Field of Classification Search ..... 123/644, 123/630, 198 D, 198 DC; 315/209 T
See application file for complete search history.

(56) References Cited

U.S. PATENT DOCUMENTS 4,658,788 A * 4/1987 Yamamoto et al. .... 123/406.54
5,113,839 A * 5/1992 Hartmann et al. ..... 123/606
5,603,308 A 2/1997 Ooyabu et al. ..... 123/644
5,967,128 A * 10/1999 Onuki et al. ..... 123/644
6,595,194 B1 * 7/2003 Ito et al. ..... 123/644

* cited by examiner

*Primary Examiner*—Willis R. Wolfe
*Assistant Examiner*—Johnny H. Hoang
(74) *Attorney, Agent, or Firm*—Nixon & Vanderhye, P.C.

(57) ABSTRACT

An ignition device for an internal combustion engine includes a power transistor connected to a primary coil of an ignition coil, a current sensing resistor connected in series with the power transistor, a constant current circuit and an abnormal oscillation control circuit that connects the gate resistor with the feedback circuit when the constant current circuit controls the primary current to be constant. The constant current circuit has a gate resistor connected in series to the control gate of the power transistor and a feedback circuit connected between the gate resistor and the current sensing resistor and controls current supplied to a control gate of the power transistor so as to control the primary current to be constant.

22 Claims, 4 Drawing Sheets

IGNITION DEVICE FOR INTERNAL COMBUSTION ENGINE

CROSS REFERENCE TO RELATED APPLICATION

The present application is based on and claims priority from Japanese Patent Applications: 2004-141211, filed May 11, 2004; and 2005-2819, filed Jan. 7, 2005, the contents of which are incorporated herein by reference.

BACKGROUND OF THE INVENTION

1. Field of the Invention

The present invention relates to an ignition device for an internal combustion engine to be mounted on various kinds of vehicles.

2. Description of the Related Art

JP-A-8-135547 or its counterpart U.S. patent, U.S. Pat. No. 5,603,308A, discloses an ignition device for an internal combustion engine that has a constant primary current control circuit. The disclosed ignition device has a network composed of a plurality of resistors to detect a potential. The potential is compared with a reference level for a feed-back control to provide a suitable gate voltage to be applied to the gate of a primary current control transistor. Although the disclosed ignition device is effective to prevent abnormal oscillation of the constant primary current control circuit, it may not provide an accurate fail signal when it fails because the fail signal is formed from the gate voltage, which may sometimes fluctuate when a power source voltage fluctuate or become to low to detect.

SUMMARY OF THE INVENTION

Therefore, it is an object of the invention to provide an improved ignition device that can accurately provide a fail signal.

Another object of the invention is to provide an ignition device the input power of which is smaller than the prior art ignition device.

According to a feature of the invention, an ignition device for an internal combustion engine includes a power transistor that supplies primary current to a primary coil of an ignition coil by supplying gate current to a control gate of the transistor, a current sensing resistor connected in series with the power transistor, a constant current circuit having a gate resistor connected in series to the control gate of the power transistor and a feedback circuit connected between the gate resistor and said current sensing resistor and switching means for connecting the gate resistor and the feedback circuit when the constant current circuit controls the primary current to be constant. The switching means disconnects the gate resistor from the feedback circuit when said constant current circuit does not operate to control the primary current or connect the gate resistor and the feedback circuit when an amount of the primary current reaches a first preset value that is smaller than the constant amount.

Therefore, not only abnormal oscillations can be effectively prevented, but also an accurate fail signal can be provided.

Preferably, the switching means disconnects the gate resistor from the feedback circuit when the amount of the primary current does not reach the first preset value. This feature saves electric power loss of the ignition device and prevents temperature rise of the same.

Further, the above described ignition device may include fail signaling means connected to the current sensing resistor to provide a fail signal if an amount of the primary current is larger than a second preset value. This feature is effective to provide a more accurate fail signal.

Preferably, the second preset value is smaller than the first preset value. The switching means of this ignition device may stop the fail signaling means from providing the fail signal when the amount of the primary current reaches the first preset value. The fail signaling means may start providing the fail signal when the amount of the primary current reaches a third preset value that is smaller than the first preset value.

BRIEF DESCRIPTION OF THE DRAWINGS

Other objects, features and characteristics of the present invention as well as the functions of related parts of the present invention will become clear from a study of the following detailed description, the appended claims and the drawings. In the drawings:

DETAILED DESCRIPTION OF THE PREFERRED EMBODIMENTS

An ignition device for an internal combustion engine according to the first embodiment of the invention will be described with reference to FIGS. 1 and 2.

Figure 1:
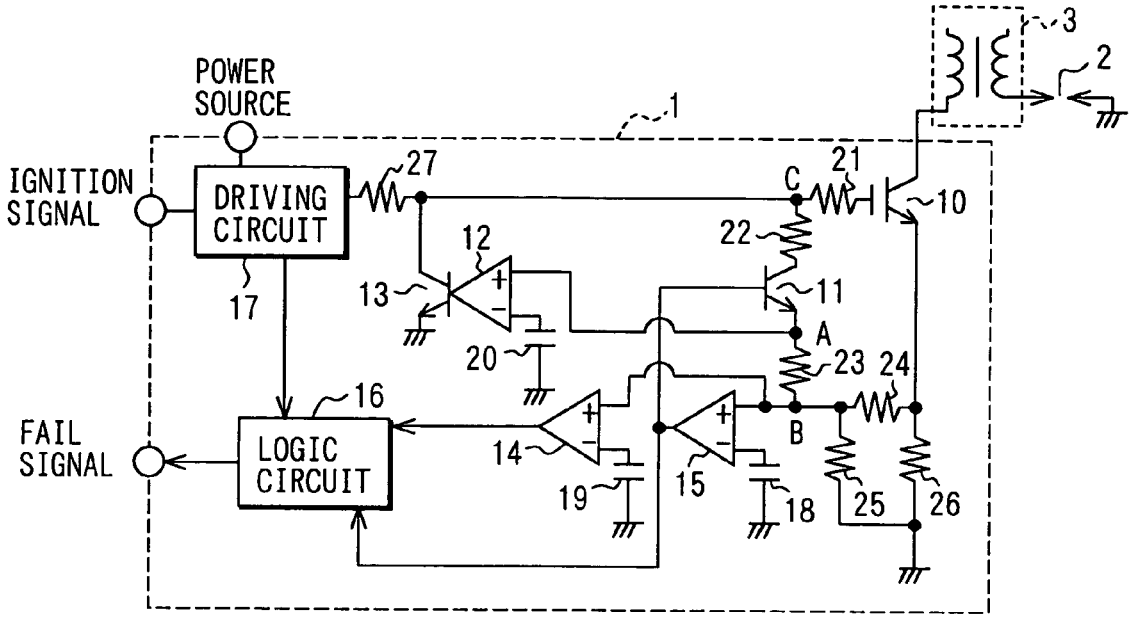
FIG. 1 is a circuit diagram of an ignition device for an internal combustion engine according to the first embodiment of the invention.
Figure 2:
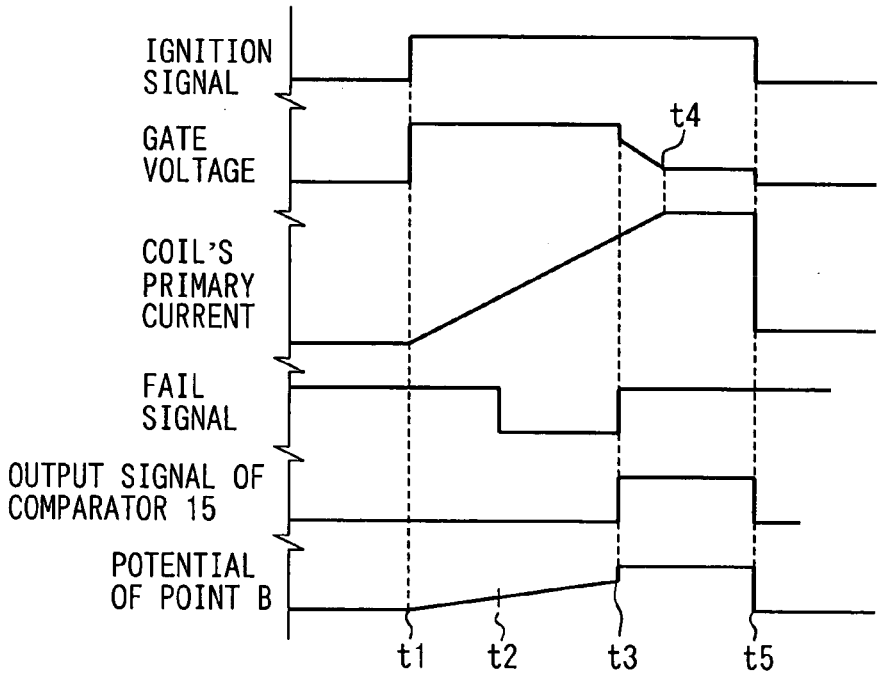
FIG. 2 is a timing diagram of signals of various portions of the ignition device shown in FIG. 1.

In FIG. 1, reference numeral 1 represents the ignition device according to the first embodiment of the invention, reference numeral 2 represents a spark plug, which is connected to an ignition coil 3. The ignition device 1 includes a primary current controlling transistor (hereinafter referred to as IGBT) 10, an abnormal oscillation control transistor 11, a constant current forming comparator 12, a comparator-driven transistor 13, a first fail-detecting comparator 14, a second fail-detecting comparator 15, a fail-signal logic circuit 16, a driving circuit 17, which has an input-protection circuit, threshold level forming circuits 18–20 and resistors 21–27.

When an ignition signal is inputted to the driving circuit 17 at time t1, power source voltage of an outside DC power source is applied to the gate of the IGBT 10 via the resistors 27 and 21 to turn it on. Accordingly, coil's primary current supplied to a primary coil of the ignition coil 3 is linearly increasing, thereby raising the potential of point A. When the potential of point A does not reach a threshold value of the constant current controlling comparator 12, the transistor 13 is kept turned off. Accordingly, the potential of point C, which is the gate voltage applied to the IGBT 10, does not drop. The abnormal oscillation control transistor 11 is also kept turned off. Therefore, the potential of point C does not affect the potential of point A (or the input signal of the constant current forming comparator 12) or the potential of point B (or the input signals of the comparators 14, 15).

When the primary coil current increases and the potential of point B becomes higher than the threshold value of the first fail-detecting comparator 14 at time t2, it provides the fail-signal logic circuit 16 with a high level voltage signal. Consequently, the fail-signal logic circuit 16 gives a fail signal after it receives the ignition signal from the driving circuit 17.

When the primary coil current increases further and the potential of point B becomes higher than the threshold value of the second fail-detecting comparator 15 at time t3, it provides the fail-signal logic circuit 16 with a high level voltage signal. Consequently, the fail-signal logic circuit 16 stops the fail signal after it receives the ignition signal from the driving circuit 17.

At the same time, the comparator 15 turns on the abnormal oscillation control transistor 11 to raise the potential of point A and point B. Since the potential of point B has become much higher than the threshold values of the comparators 14, 15, the comparators 14, 15 will not change their operation.

When the primary coil current increases further and the potential of point A becomes higher than the threshold value of the constant current forming comparator 12 at time t4, it provides the comparator-driven transistor 13 with a high level voltage signal to turn on, so that the potential of point C drops. Thereafter, the comparator 12 carries out a feedback control to adjust the potential of point A to the threshold value provided by a threshold voltage source 20.

The resistors 22–26 form a circuit that prevents an abnormal oscillation and cooperates with the comparator 12 and the transistor 13 to provide constant current. Further, the resistors 24, 25 cooperate with the resistor 26 to detect the amount of the primary current. That is, the potential of point B is almost proportional to the amount of the primary current. While the transistor 11 is turned on, the potential of point A (or the input signal of the comparator 12), which is a fraction of the difference between the potential of point C and the potential of point B divided by the resistor 22 and the resistor 23, increases. That is, when the primary current is controlled by the IGBT 10, the gate current is delayed by a time constant formed by the resistor 21 and a capacitor of the gate of the IGBT 10 to prevent an abnormal oscillation of the IGBT 10. The signal of the potential of point C, which nearly corresponds to the gate voltage of the IGBT 10, is fed back to the comparator 12 without passing the IGBT 10. Therefore, the delay of the gate current of the IGBT 10 can be cancelled.

When the level of the ignition signal becomes low, the potential of point C drops significantly, and the IGBT 10 is turned off. As a result, the primary current stops, and the comparators 14, 15 provide low level output signals.

That is, when the amount of the primary current is detected to provide the fail signal, the abnormal oscillation control transistor 11 is turned off to prevent the input signals of the comparators 14, 15 from being badly affected. After the comparators 14, 15 have provided the fail signal, the abnormal oscillation control transistor 11 is turned on to prevent the abnormal oscillation of the IGBT 10.

Figure 3:
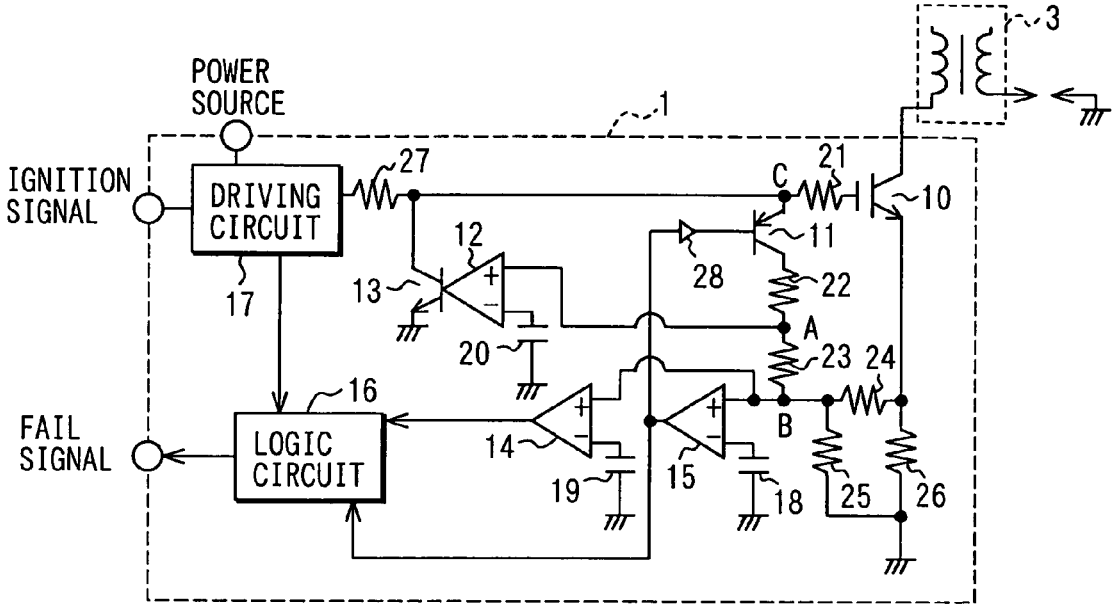
FIG. 3 is a circuit diagram of an ignition device for an internal combustion engine according to the second embodiment of the invention.

An ignition device for an internal combustion engine according to the second embodiment of the invention will be described with reference to FIG. 3. Incidentally, the same reference numeral represents the same or substantially the same part, portion or component as the first embodiment.

The type of the abnormal oscillation control transistor 11 is changed from a npn type to a pnp type. The pnp type transistor 11 is controlled by the fail-signal logic circuit 16 via an inverter circuit 28. The operation of the ignition device is substantially the same as the ignition device according to the first embodiment.

Figure 4:
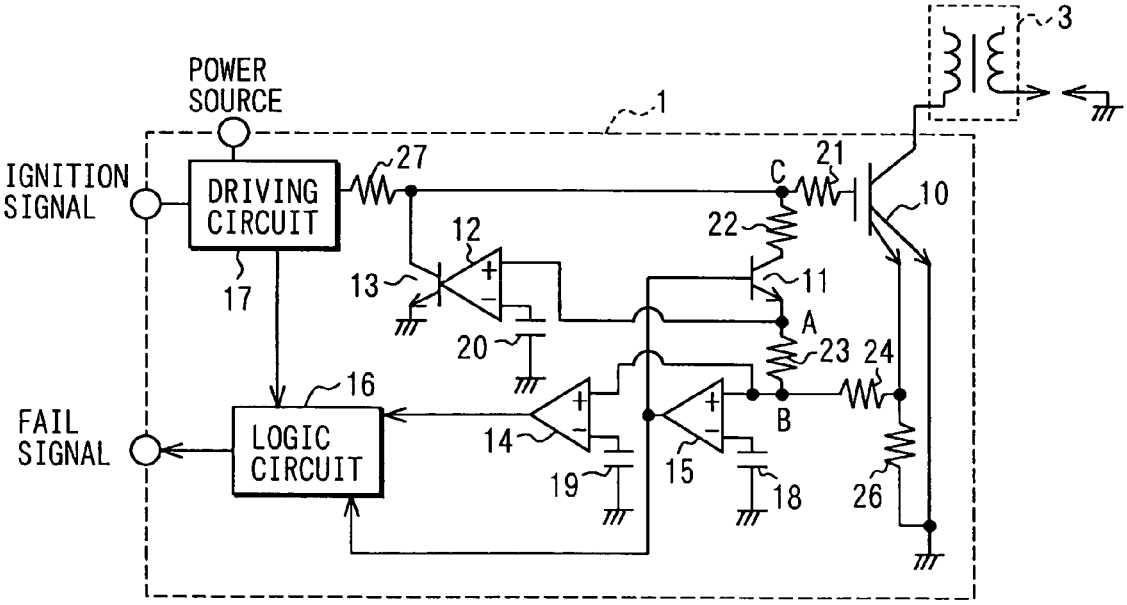
FIG. 4 is a circuit diagram of an ignition device for an internal combustion engine according to the third embodiment of the invention.

In an ignition device for an internal combustion engine according to the third embodiment of the invention, the type of the IGBT 10 is changed to have a current detecting terminal. The resistor 25 of the first embodiment is also omitted, as shown in FIG. 4.

Figure 5:
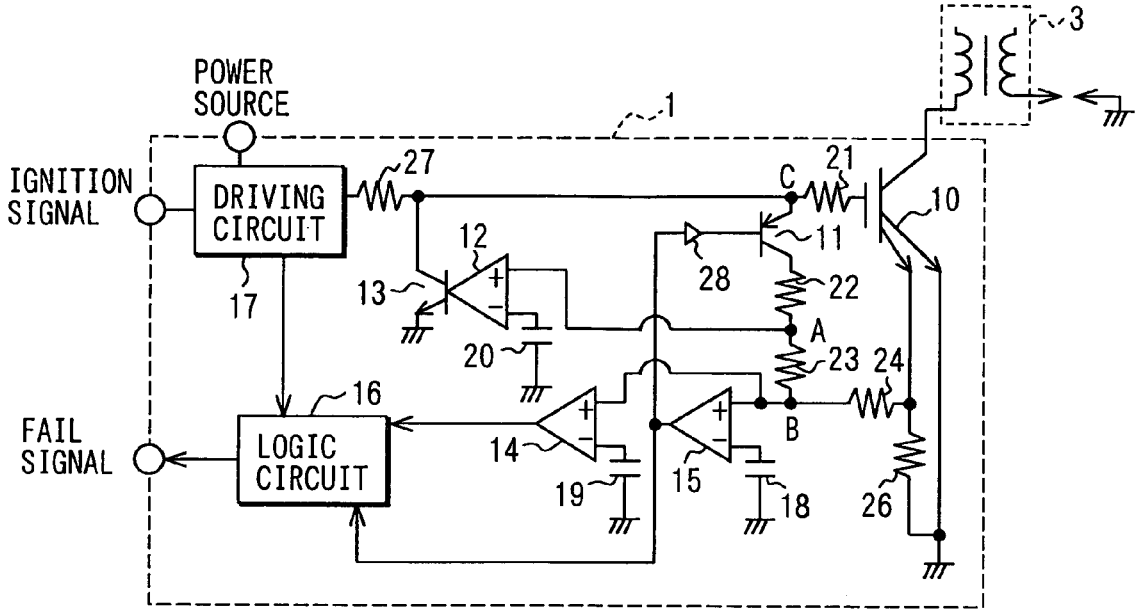
FIG. 5 is a circuit diagram of an ignition device for an internal combustion engine according to the fourth embodiment of the invention.

An ignition device for an internal combustion engine according to the fourth embodiment of the invention is constructed of the mixture of the above described changes, as shown in FIG. 5.

In any of the above embodiment, the switching of the transistor 11 may be controlled by a timer instead of the output signal of the comparator 15.

Figure 6:
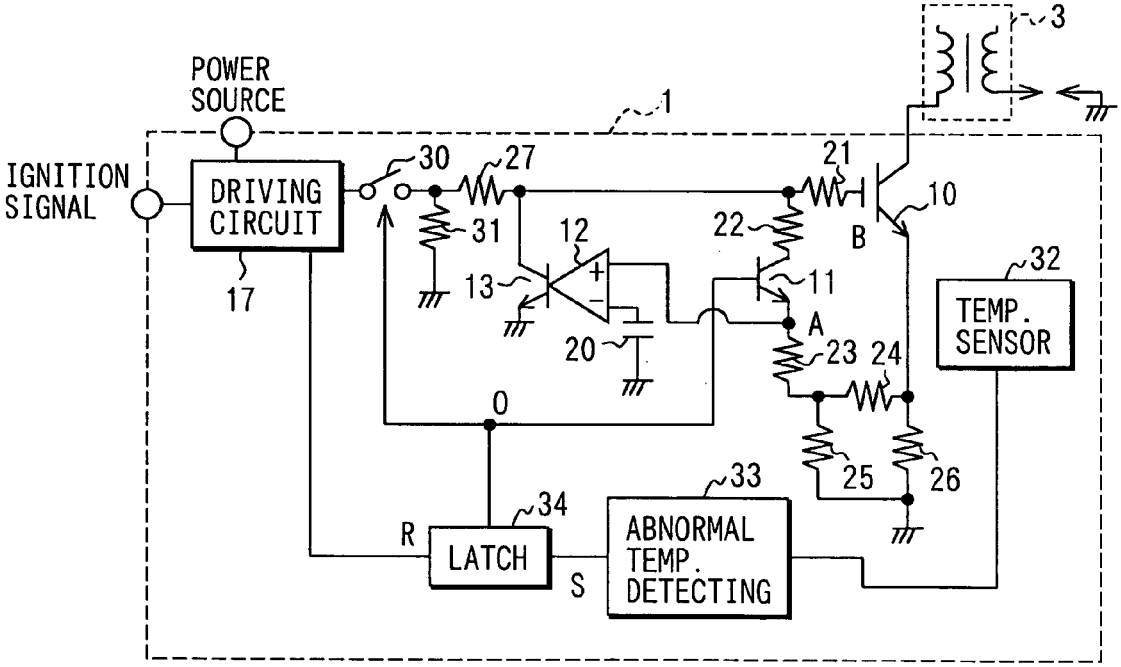
FIG. 6 is a circuit diagram of an ignition device for an internal combustion engine according to the fifth embodiment of the invention.
Figure 7:
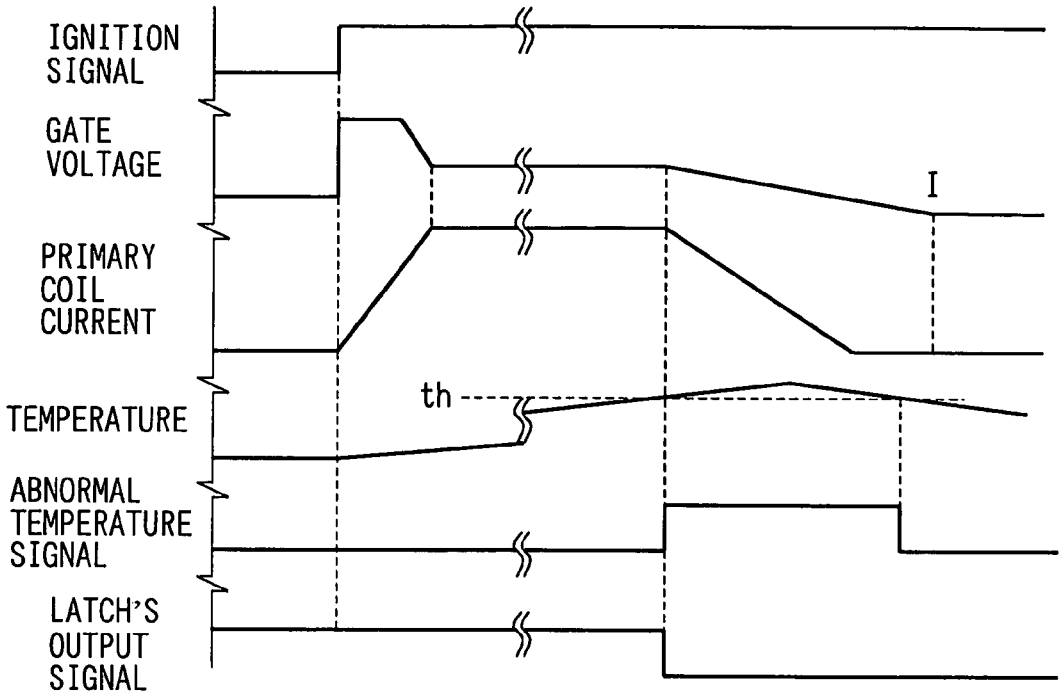
FIG. 7 is a timing diagram of signals of various portions of the ignition device shown in FIG. 6.
Figure 8:
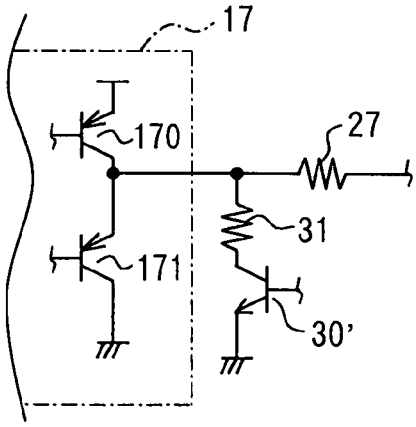
FIG. 8 is a fragmentary circuit diagram of a portion of the ignition device according to a modification of the fifth embodiment of the invention.

An ignition device for an internal combustion engine according to the sixth embodiment of the invention will be described with reference to FIGS. 6 and 7. The comparators 14, 15 and the fail-signal logic circuit 16 of the above described ignition device are replaced with a transfer switch 30, a resistor 31, a temperature sensor 32, an abnormal temperature detecting circuit and a latch circuit 34.

The temperature sensor 32 is a thermistor element disposed near the IGBT 10 that sends a temperature responsive voltage signal to the abnormal temperature detecting circuit 33. Incidentally, the temperature sensor 32 may be integrated into the IGBT 10.

The abnormal temperature detecting circuit 33 compares the temperature responsive voltage signal with a preset threshold value provided by a constant voltage circuit (not shown) and sends an output signal to the latch circuit 34. The latch circuit 34 provides the switch 30 and the transistor 11 with a high level signal if the temperature of the IGBT 10 is lower than a preset temperature or a low level signal if the temperature of the IGBT 10 is higher than the preset temperature, as shown in FIG. 7. The latch circuit 34 is reset if the driving circuit 17 provides it with a reset signal.

The switch 30 is connected between the driving circuit 17 and the resistor 27, and the resistor 31 is connected between the junction of the switch 30 and the resistor 27 and a ground.

If the temperature of the IGBT 10 becomes abnormally high, the abnormal temperature detecting circuit 33 turns off the switch 30 to stop the current supplied to the gate of the IGBT 10 from the driving circuit 17. The abnormal temperature detecting circuit 33 also turns off the transistor 11 so that the primary coil current flowing through the IGBT 10 can gradually decrease. Therefore, the secondary coil of the ignition coil 3 is prevented from generating such high voltage that can ignite fuel of an engine, as shown in FIG. 7.

In the above embodiment, the switch 30 may be replaced with a transistor 30' that turns on to connect the output terminal of the driving circuit 17 to a ground if the temperature of the IGBT 10 becomes abnormally high while turning off driving transistors 170, 171 of the driving circuit.

This circuit prevents current flowing through the resistor 31 while the driving circuit 17 is turning on the IGBT 10.

The above arrangement can be applied to some other cases to turn off the IGBT 10 than the case of abnormal temperature. The abnormal oscillation control transistor 11 is only necessary to turn off to provide constant current. However, the abnormal oscillation control transistor 11 may be turned on before the constant current is provided.

In the foregoing description of the present invention, the invention has been disclosed with reference to specific embodiments thereof. It will, however, be evident that various modifications and changes may be made to the specific embodiments of the present invention without departing from the scope of the invention as set forth in the appended claims. Accordingly, the description of the present invention is to be regarded in an illustrative, rather than a restrictive, sense.

What is claimed is:

1. An ignition device for an internal combustion engine comprising:

a power transistor, having a main gate to be connected to a primary coil of an ignition coil and a control gate, for supplying primary current to the primary coil by supplying gate current to the control gate;

a current sensing resistor connected in series with said power transistor;

a constant current circuit, having a gate resistor connected in series to the control gate of said power transistor and a feedback circuit connected between the gate resistor and said current sensing resistor, for controlling the primary current to have a constant amount; and switching means for switching connection between the gate resistor and the feedback circuit, wherein said switching means turns on when said constant current circuit controls the primary current to have the constant amount.

2. The ignition device as claimed in claim 1, wherein said switching means turns off to disconnect the gate resistor from the feedback circuit when said constant current circuit does not operate to control the primary current.

3. The ignition device as claimed in claim 1, wherein said switching means turns on to connect the gate resistor and the feedback circuit when an amount of the primary current reaches a first preset value that is smaller than the constant amount.

4. The ignition device as claimed in claim 3, wherein said switching means turns off to disconnect the gate resistor from the feedback circuit when the amount of the primary current does not reach the first preset value.

5. The ignition device as claimed in claim 3, further comprising fail signaling means, connected to the current sensing resistor, for providing a fail signal if an amount of the primary current is larger than a second preset value.

6. The ignition device as claimed in claim 5, wherein the second preset value is smaller than the first preset value.

7. The ignition device as claimed in claim 5, wherein said switching means stops said fail signaling means from providing the fail signal when the amount of the primary current reaches the first preset value.

8. The ignition device as claimed in claim 7, wherein said fail signaling means starts providing the fail signal when the amount of the primary current reaches a third preset value that is smaller than the first preset value.

9. The ignition device as claimed in claim 1, further comprising coil's abnormality detecting means and second switching means for stopping the gate current supplied to the gate of said power transistor when said coil's abnormality detecting means detects an abnormality.

10. The ignition device as claimed in claim 1, wherein said feedback circuit comprises:

a constant current controlling comparator having an input terminal connected to the current sensing resistor; and a transistor having a control gate connected to the constant current controlling comparator and a main gate connected between the gate resistor and a ground.

11. The ignition device as claimed in claim 5, wherein said fail signaling means comprises:

a fail detecting comparator having an input terminal connected to the current sensing resistor and an output terminal providing an output signal when the potential of the input terminal thereof reaches a first threshold level of the comparator; and a logic circuit, connected to the output terminal of said fail detecting comparator, for providing the fail signal when the logic circuit receives the output signal from the fail detecting comparator.

12. The ignition device as claimed in claim 11, wherein:

said fail signaling means comprises another comparator having an input terminal connected to the current sensing resistor and an output terminal connected to the logic circuit, and said another comparator provides an output signal for stopping the fail signal when the potential of the input terminal thereof becomes a second threshold level that is higher than the first threshold level.

13. The ignition device as claimed in claim 12, wherein said switching means comprises a transistor having a control gate connected to said another comparator to turn on said transistor to connect the gate resistor and the feedback circuit when said another comparator provides the output signal.

14. An ignition device for an internal combustion engine comprising:

a power transistor, having a main gate to be connected to a primary coil of an ignition coil and a control gate, which supplies primary current to the primary coil by supplying gate current to the control gate;

a current sensing device connected in series with said power transistor;

a constant current circuit, having a gate resistor connected in series to the control gate of said power transistor and a feedback circuit connected between the gate resistor and said current sensing device, which controls the primary current to have a constant amount; and a transistor which switches connection between the gate resistor and the feedback circuit so that the transistor turns on when said constant current circuit controls the primary current to have the constant amount.

15. The ignition device as in claim 14, wherein said transistor turns off to disconnect the gate resistor from the feedback circuit when said constant current circuit does not operate to control the primary current.

16. The ignition device as in claim 14, wherein said transistor turns on to connect the gate resistor and the feedback circuit when an amount of the primary current reaches a first preset value that is smaller than the constant amount.

17. The ignition device as in claim 16, wherein said transistor turns off to disconnect the gate resistor from the feedback circuit when the amount of the primary current does not reach the first preset value.

18. The ignition device as in claim 14, further comprising a fail signaling circuit, connected to the current sensing device, which provides a fail signal if an amount of the primary current is larger than a preset value.

19. The ignition device as in claim 16, further comprising a fail signaling circuit connected to the current sensing device, which provides a fail signal if an amount of the primary current is larger than a second preset value.

20. The ignition device as in claim 19, wherein the second preset value is smaller than the first preset value.

21. The ignition device as claimed in claim 20, wherein said transistor stops said fail signaling circuit from providing the fail signal when the amount of the primary current reaches the first preset value.

22. The ignition device as in claim 18, wherein said fail signaling circuit comprises:

a fail detecting comparator having an input terminal connected to the current sensing device and an output terminal providing an output signal when the potential of the input terminal thereof reaches a threshold level of the comparator; and a logic circuit, connected to the output terminal of said fail detecting comparator, which provides the fail signal when the logic circuit receives the output signal from the fail detecting comparator.

* * * * *